US005974585A

United States Patent [19]

Bachner, Jr.

[11] Patent Number: 5,974,585

[45] **Date of Patent: *Nov. 2, 1999**

[54] CONCEALABLE PROTECTIVE GARMENT FOR THE GROIN AND METHOD OF USING THE SAME

[75] Inventor: Thomas E. Bachner, Jr., Eastport, Mich.

[73] Assignee: Second Chance Body Armor, Inc., Central Lake, Mich.

[ * ] Notice: This patent is subject to a terminal disclaimer.

[21] Appl. No.: 08/735,027

[22] Filed: Oct. 22, 1996

Related U.S. Application Data

[63] Continuation-in-part of application No. 08/691,251, Aug. 2, 1996.

[51] Int. Cl.[6] ..... F41H 1/02

[52] U.S. Cl. ..... 2/2.5; 2/463; 2/466; 428/911

[58] Field of Search ..... 2/2.5, 102, 466, 2/465; 428/911

[56] References Cited

U.S. PATENT DOCUMENTS

| | | | |
|---|---|---|---|
| 4,413,357 | 11/1983 | Sacks | 2/2.5 |
| 4,497,069 | 2/1985 | Branunhut | 2/2.5 |
| 4,608,717 | 9/1986 | Dumbavand | 2/2.5 |
| 4,774,724 | 10/1988 | Sacks | 2/2.5 |
| 4,989,266 | 2/1991 | Borgese et al. | 2/2.5 |
| 5,060,314 | 10/1991 | Lewis | 2/2.5 |
| 5,327,811 | 7/1994 | Price et al. | 2/2.5 |
| 5,398,340 | 3/1995 | Kibbee | 2/2.5 |
| 5,431,318 | 7/1995 | Gacia | 2/2.5 |
| 5,479,659 | 1/1996 | Bachner, Jr. | 2/2.5 |
| 5,495,621 | 3/1996 | Kibbee | 2/2.5 |
| 5,578,358 | 11/1996 | Foy et al. | 2/2.5 |
| 5,589,254 | 12/1996 | Dischler | 2/2.5 |
| 5,619,748 | 4/1997 | Nelson et al. | 2/2.5 |
| 5,622,771 | 4/1997 | Chiou et al. | 2/2.5 |

*Primary Examiner*—John J. Calvert
*Assistant Examiner*—Larry D. Worrell, Jr.
*Attorney, Agent, or Firm*—Wildman, Harrold Allen & Dixon; Thomas J. Ring

[57] ABSTRACT

A protective garment for covering a frontal chest, waist and groin areas of a wearer which includes, a panel constructed of a plurality of sheets in which each sheet is constructed of flexible woven high strength protective fibers and in which the panel is formed for underlying clothing which covers the frontal waist area of the wearer and in which the panel extends continuously to overlie the frontal chest area down to and over the frontal waist and groin areas of the wearer. Various straps are used for releasably securing the panel to and maintaining the panel in a position overlying the frontal chest, waist and groin areas of the wearer.

76 Claims, 6 Drawing Sheets

CONCEALABLE PROTECTIVE GARMENT FOR THE GROIN AND METHOD OF USING THE SAME

CROSS-REFERENCES TO RELATED APPLICATION

This application is a continuation-in-part of U.S. patent application Ser. No. 08/691,251 entitled "Puncture Resistant Protective Garment and Method of Making and Testing Same" of Thomas E. Bachner, Jr., filed Aug. 2, 1996.

BACKGROUND OF THE INVENTION

1. Field of the Invention

This invention relates to body protective garments and more particularly to protective garments which will protect a body in the groin area from weapons which inflict puncture wounds and ballistic wounds.

2. Description of the Related Art Including Information Disclosed Under 37 CFR 1.97–1.99

Various protective garments are known which utilize separately securable groin pads which are externally placed about the groin area of the wearer. Such protective garments having groin pads are often rigid, bulky and are externally worn outside of the clothing of a wearer. A protective garment having a groin pad which is separate and releasably attachable as an accessory to the remainder of the protective armor jacket is shown in U.S. Pat. No. 5,060,314 issued Oct. 29, 1991 to Lewis. Unfortunately, the bulk, inflexibility and rigidity of such body armor jackets requires that they be worn externally and thus, are not concealable. Accordingly, such rigid garments, especially those having external attachable groin pad accessories, are not conducive for undercover operations by law enforcement or security personnel. Any element of surprise against a would-be attacker is lost since such rigid and bulky separate accessories must be externally worn by the user and are obviously seen by the attacker. Thus, the attacker is more apt to attack an unprotected area of the body.

Moreover, the rigidity of such external groin accessories significantly restricts the mobility of the wearer and therefore, the accessories are often not even worn by the law enforcement, military or safety personnel wearer. Furthermore, with the groin pads being separate from the remainder of the protective garment, such groin pad accessories require the added step of attaching the external pad, which results in an additional time consuming operation in which such time often may not be available to the user under attack. Also, within the context of close combat, the externally worn groin pad may be moved by the attacker giving the attacker an opportunity to strike a devastating blow.

Other externally placed protective items are known to have a separate groin pad which is folded over and overlies a portion of the protective article at a waist pouch. The separate groin accessory is releasably secured to and deployable from a waist pouch carried externally about the wearer's waist. Such an externally carried separate groin pad accessory deployable from a waist pouch can be seen in the Police Pouch™ device of Second Chance Body Armor, Inc. of Central Lake, Mich. and as shown in U.S. patent application Ser. No. 08/323,854 of Richard Davis entitled "Ballistic Resistant Garment Assembly and Method Of Using The Same", filed Nov. 25, 1992. This groin pad, separately carried in the waist pouch, requires the added step of deploying it in order to serve any protection of the groin area. If time permits, deployment of the groin pad accessory from the pouch is made. Only then is the pad externally positioned about the groin area to provide protection in this area. Once again, the external pad is not concealable underneath the clothing of the wearer and is not deployed at all times. Furthermore, the pad may reduce the mobility of the wearer and by being externally worn is prone to movement out of position by an attacker thereby potentially exposing vital organs intended to be protected.

Another externally worn and separately attachable/detachable groin pad accessory is shown in U.S. Pat. No. 5,327,811 issued Jul. 12, 1994 to Price et al. This groin pad accessory is secured to the front of a body armor device by mating hook and loop fasteners and thus, suffers from the disadvantages of such bulky, external and separate groin pads as previously discussed.

Other relatively cumbersome groin pad inserts exist which are also separate from a protective vest garment. A protective vest garment used with such separate groin pad accessories is worn such that the vest is positioned generally at least one inch above the belt line in order to prevent the bottom of the vest from uncomfortably binding with the belt of the wearer when moving about or sitting. Such separately segmented groin and vest arrangements disadvantageously leave an unprotected area proximate the lower abdominal region of the wearer. Additionally, such arrangements unfortunately provide an unprotected separation between the two distinct elements of the vest and the groin pad, subjecting the wearer to vulnerability in the exposed area to serious injury, if not a fatal one.

SUMMARY OF THE INVENTION

It is therefore a principal object of the present invention to provide a protective garment in which the disadvantages of known protective garments and accessories noted above are overcome by providing a flexible, thin, lightweight continuous and wearable ballistic resistant and/or puncture resistant garment which concealably protects the chest and groin areas of the wearer.

It is therefore an object of the present invention to provide a protective garment for covering a frontal chest, waist and groin areas of a wearer which includes, a panel constructed of a plurality of sheets in which each sheet is constructed of flexible woven high strength protective fibers in which the panel is formed for underlying clothing covering the frontal waist area of the wearer and in which the panel extends continuously to overlie the frontal chest area down to and over the frontal waist and groin areas of the wearer and it also includes apparatus for releasably securing the panel to and maintaining the panel in a position overlying the frontal chest, waist and groin areas of the wearer.

It is another object of the present invention to provide a method for positioning a protective garment onto a wearer, which includes the steps of placing a panel constructed of a plurality of sheets in which each sheet is constructed of flexible woven high strength protective fibers and in which the plurality of sheets are formed to overlie a chest area and extend continuously downwardly to overlie a waist and groin areas of the wearer another step includes releasably securing the panel to the body of the wearer and another step includes positioning a wearing apparel garment which engages the waist area of the wearer overlying the panel and in which the wearing apparel garment extends downwardly therefrom to overlie the panel at the groin area.

BRIEF DESCRIPTION OF THE DRAWING

The foregoing objects and advantageous features of the invention will be explained in greater detail and others will be made apparent from the detailed description of the preferred embodiment of the present invention which is given reference to the several figures of the drawing, in which.

DETAILED DESCRIPTION

Figure 1:
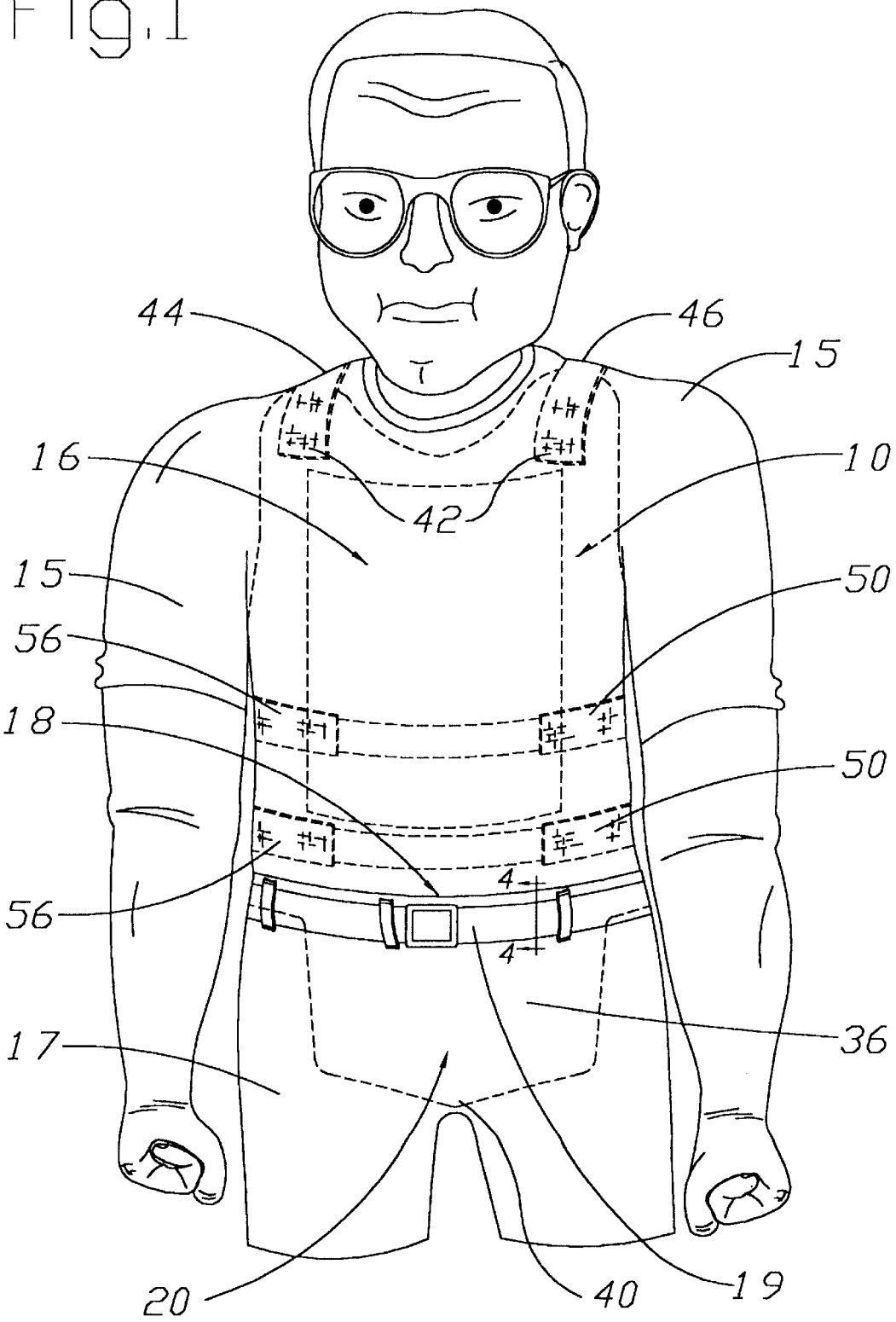
FIG. 1 is a perspective of the protective garment as worn by a wearer.
Figure 2:
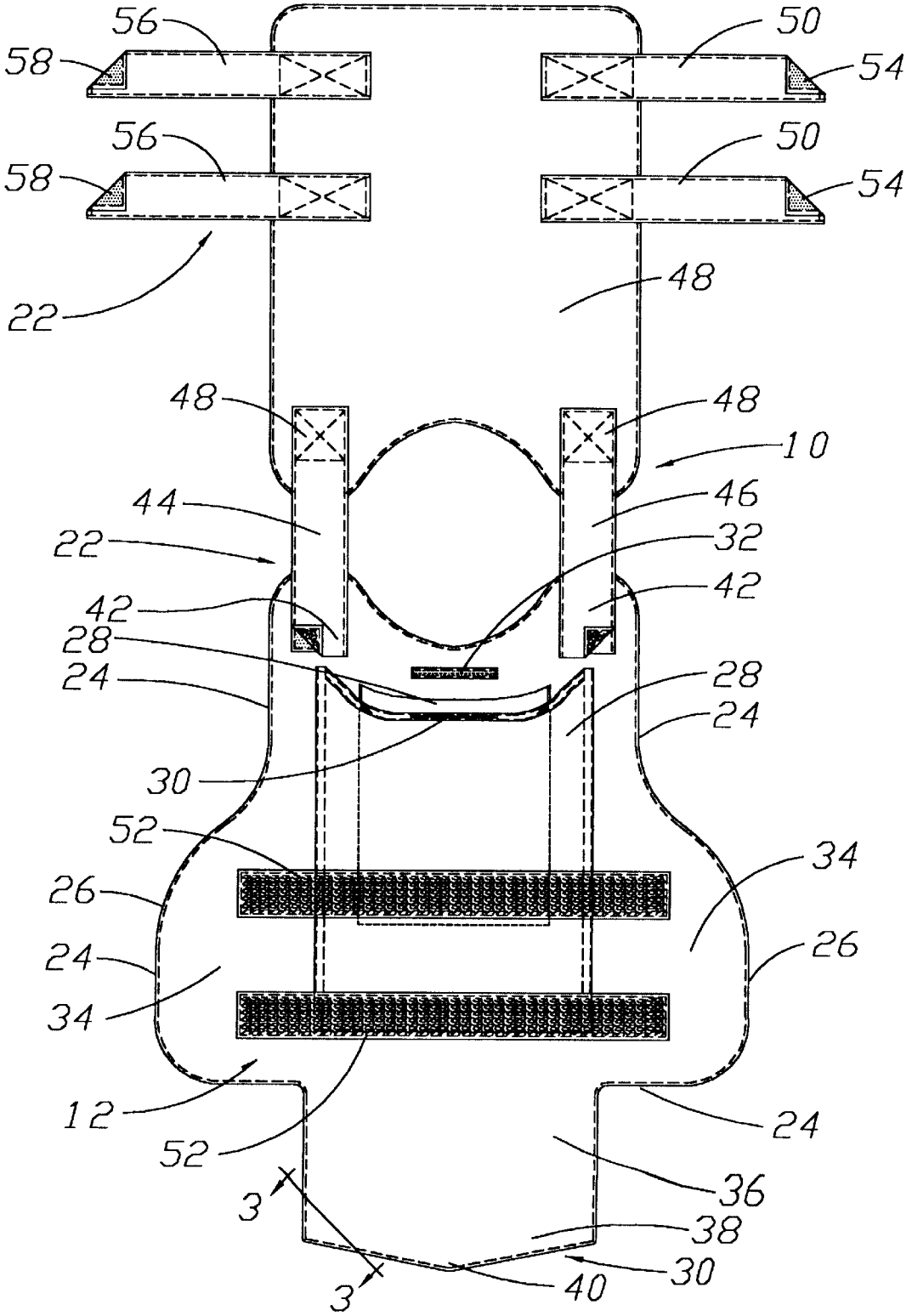
FIG. 2 is a top plan view of the protective garment not worn and lying flat and fully extended with the outer side front portion of the garment shown at the bottom and the outer side back portion shown at the top.
Figure 3:
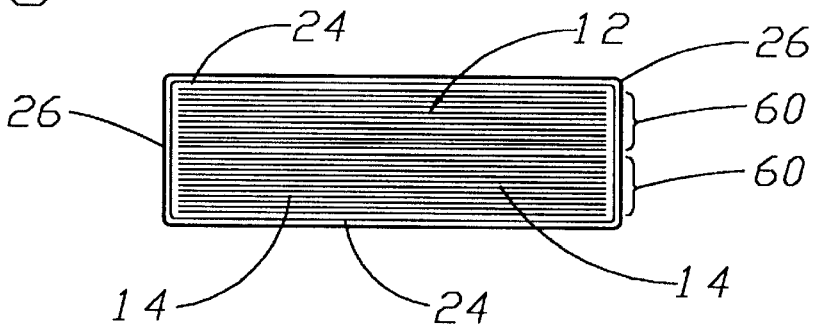
FIG. 3 is a cross section view of the protective garment taken along line 3—3 of FIG. 2.
Figure 4:
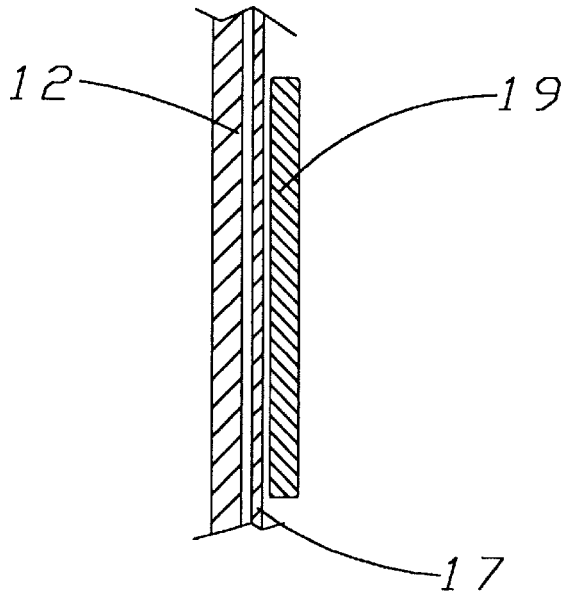
FIG. 4 is a cross section view of the protective garment taken along line 4—4 in FIG. 1.

As seen in FIGS. 1 and 2, a protective garment 10 for covering the chest, waist and groin areas of a wearer is shown. Protective garment 10, utilized to protect a wearer from ballistic projectiles and/or puncture wounds, includes a panel 12, as seen in FIG. 3, which is constructed of a plurality of overlying sheets 14. These sheets 14 constructed of flexible woven high strength protective fibers such as aramid fibers and the like, which will be discussed in more detail below. Panel 12 is formed to be thin and flexible in order to be concealed when being worn to underlie the clothing 15 such as a shirt of the wearer and to cover the frontal waist area 18 of the wearer, as seen in FIG. 1. As seen in FIG. 4, contiguous panel 12 is positioned to underlie the clothing, ie. pants 17 and belt 19 of the wearer. This same construction of panel 12 permits it to extend continuously to cover the frontal chest 16 area down to and over the frontal waist 18 and groin 20 areas of the wearer and be positioned under clothing 15 in all areas. The continuously formed panel 12 of garment 10 is secured to the wearer and positioned to overlie the frontal chest 16, waist 18 and groin 20 areas of the wearer and will be set forth below in more detail below.

Panel 12 is held within a sleeve 24, as seen in FIGS. 2 and 3, which covers and encloses the panel of layered sheets 14 of woven aramid fiber. Sleeve 24 is substantially the same shape as panel 12 and is preferably constructed of waterproof and moisture vapor permeable material such as GORE-TEX®, manufactured by W. L. Gore & Associates, Inc. of Newark, Del., however, other materials of the like are contemplated. This sleeve 12 permits the aramid fiber to breathe and keeps out undesirable amounts of moisture from deteriorating panel 12. Such construction of sleeve is set forth in more detail in U.S. Pat. No. 5,471,906 issued Dec. 5, 1995, assigned to Second Chance Body Armor, Inc., of Central Lake, Mich. and W. L. Gore & Associates.

Sleeve 24 is typically stitched at the edges to maintain panel 12 within sleeve 24. Likewise, panel 12 is of a dimension being slightly smaller and substantially congruent as sleeve 24 thereby preventing panel 12 formed of the layered sheets 14 of woven high strength protective fibers from sliding, binding up or other undesirable movement within sleeve 24.

An outer carrier 26, as seen in FIGS. 2 and 3, is used for enclosing and carrying panel 12, for which the panel is further enclosed by sleeve 24. The outer carrier 26 also encloses and covers the protective sleeve 24 encasing the ballistic resistant and/or puncture resistant panel 12. Carrier 26 is preferably constructed of a strong and durable material such as polyester cotton or the like. Carrier 26 has openings in a sidewall of carrier 26 in order to allow air to move into and out of carrier 26 and contact sleeve 24 of panel 12.

Carrier 26 provides another important structure for this protective garment with defining at least one pocket member 28 in a sidewall of carrier 26, as shown in FIG. 2 where two separate pockets appear. Moreover, the cotton or polyester material of carrier 26 provides an open mesh to allow air to pass through it to facilitate evaporation of sweat and, at the same time, the material itself wicks sweat to the surface for quicker evaporation. Such pockets 28 will carry additional core panels (not shown) for protection against ballistic missiles and/or puncture wounds. Pockets 28 are positioned, in FIG. 2, to overlie the sternum of the wearer, which is a vital anatomical area of the wearer. Alternatively, the pockets 28 can be positioned in other vital areas of the wearer depending on the additional protection desired for that particular area. These pockets 28 carry a VELCRO® strip 30 which releasably mate with another strip 32 of VELCRO® positioned on a sidewall of carrier 26 to provide ease in securing and insertion of a separate core panel into the pocket and for ease in removal of such separate core panel.

A separate core panel for positioning within pocket 28 is selectively constructed of a variety of materials. A soft core panel for ballistic resistance will preferably be constructed of woven aramid fibers such as KEVLAR®, manufactured by DuPont Company of Wilmington, Del., SPECTRA®, manufactured by Allied Signal Corp. of Morristown, N.J., into sheets which are positioned to overlie one another as well as using other ballistic resistant cores of woven fibers as discussed below and the like. A core panel is also alternatively constructed from composite material such as GOLD FLEX® reinforced plastic material or other composite materials such as GOLD SHIELD®, SPECTRA SHIELD®, SPECTRA FLEX®which are manufactured by Allied Signal Corp., or steel armor plate or titanium depending on the need of stopping a particular attacking force.

Panel 12, as seen in FIG. 2, has laterally extending waist portions 34 which wrap about the sides of the wearer at the waist area 18 of the wearer protecting the wearer in these vulnerable locations. Panel 12 narrows in width at a groin portion 36 which overlies the groin area 20 relative to the waist portions 34 overlying the waist area 18. Groin portion 36 extends continuously downwardly from the waist portions 34 in which the groin portion 36 tapers in width at a lower portion 38 accommodating the general contour of the wearer's body providing lesser inhibition in movement of the wearer's legs. Moreover, an extension portion 40 extends further down along panel 12 from lower portion 38 optimizing coverage of the wearer's vital portion of anatomy.

Protective garment 10 is worn and maintained in position on the wearer's body with securing device 22. A securement apparatus 22 includes one end 42 of each of two spaced apart straps 44, 46 secured to a top portion of panel 12, as seen FIGS. 1 and 2. The two spaced apart straps 44, 46 rest on the wearer's shoulders on either side of a head of the wearer. The other ends 49 of two spaced apart straps 44, 46 are preferably secured to back panel 48 which overlies the back of the wearer.

Additionally, securement mechanism 22 includes at least one strap member 50 which is attachable secures to panel 12 and extends around the side of the wearer and secures to back panel 48. A strip 52 disposed over panel 12 and first end 54 of strap member 50 carry releasably securing mating hook and loop members, such as VELCRO® or the like, for releasably securing first end 54 at a desired position along strip 52. In the preferred embodiment two strap members 50 are spaced apart from one another and are positioned for going around one side of the wearer. A second strap member 56 has a first end 58 of second strap member 56 and strip 52 carry releasably securing mating hook and loop members, such as VELCRO® or the like, for releasably securing first end 58 at a desired position along strip 52. Preferably two straps 58 are spaced apart from one another and are positioned for going around the wearer on an opposing side of the wearer than the one strap member 50. This securement apparatus 22 permits the wearer to tighten securement of panel 12 to his or her particular body size and shape and can secure panel 12 tight enough so as to resist it including groin portion 36 from slipping out of position.

In the present invention, panel 12 is constructed to resist infliction of wounds to the wearer from penetration of ballistic missiles from gun shots and/or likewise resist penetration of sharp edged weapons and yet at the same time be sufficiently flexible and thin in order to be worn in a concealed fashion under the clothing at a groin region of the wearer. This construction provides panel 12 to extend continuously from the chest area 16 downward through the waist area 18 and over the groin area 20 permitting freedom of movement of the wearer without binding at the waist area 18 of the wearer regardless of the wearer's position. The waist area 18, thereby is continuously covered, even under the waist and belt 19 of the wearer, as seen in FIG. 4, permitting uninterrupted coverage therefrom downwardly over the groin area 20. Various embodiments for these constructions are discussed in detail below.

Figure 5:
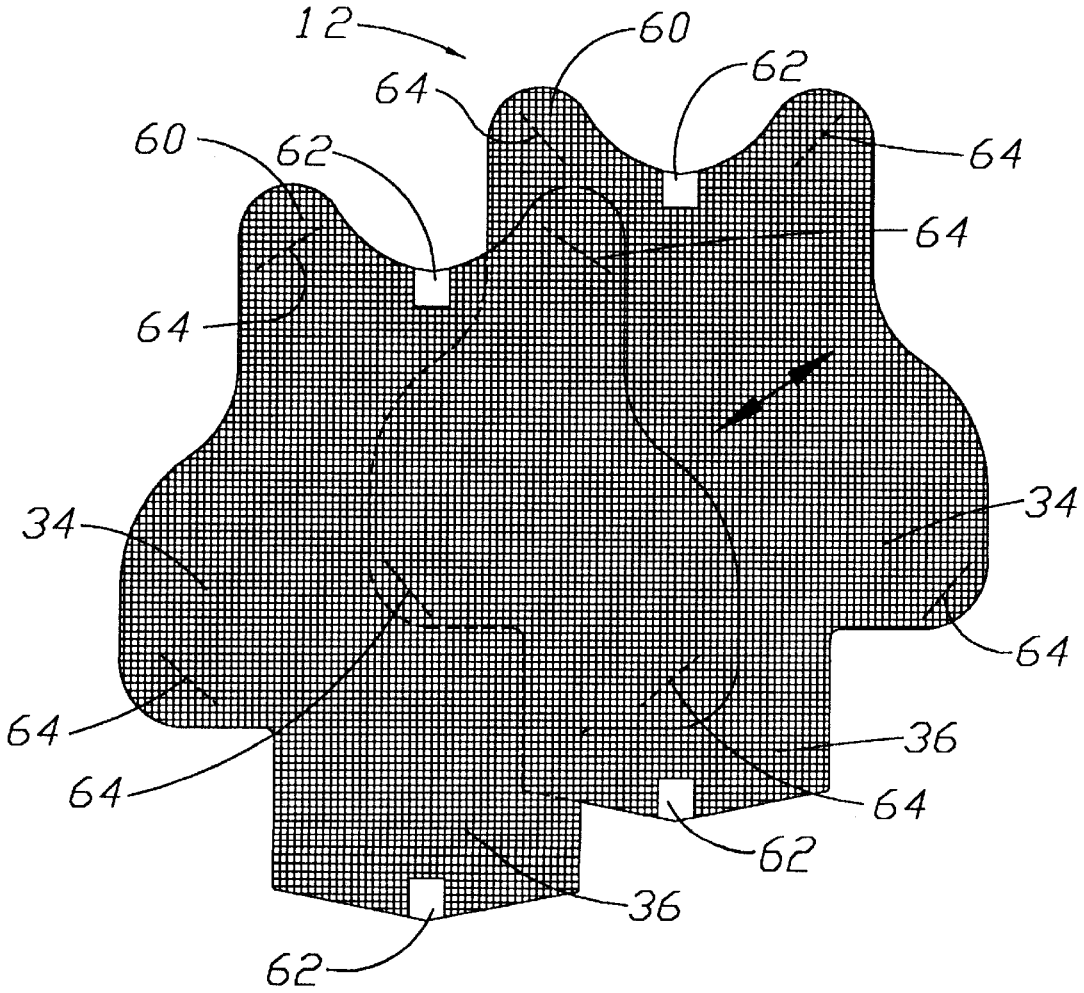
FIG. 5 is an exploded view of sub-panels of the panel of the front portion of the protective garment without a sleeve.

A first embodiment of construction of panel 12 is shown in FIG. 5 which resists puncture from attacks with sharp edged weapons such as knives, awls, ice picks and the like. A puncture resistant garment which resists such puncture penetration, but which does not provide coverage for the wearer from the waist area continuously downwardly over the groin area, is known as Prism™ MW Thrust I, manufactured by Second Chance Body Armor, Inc. is described in U.S. patent application Ser. No. 08/691,251 entitled "Puncture Resistant Protective Garment And Method For Making And Testing Same" of Thomas E. Bachner, Jr. filed Aug. 2, 1996, assigned to the same assignee of the present invention and is hereby incorporated by reference.

Panel 12 is puncture resistant having woven aramid fibers arranged in a weave of at least sixty (60) aramid fibers per inch in one direction and at least sixty (60) aramid fibers per inch in another direction transverse to the one direction. The aramid fibers have at least one of the following characteristics of: a) the aramid fibers are constructed of filaments which provide from 50,000,000 up to 90,000,000 filament crossovers per square inch in the plurality of woven sheets 14, b) the aramid fibers provide greater than 3 per cent of break elongation and c) the aramid fiber provides greater than a 23.8 grams per denier tenacity.

Preferably, the aramid fiber woven in the sheets of such puncture resistant panel is at least 200 denier, having at least 3.45% break elongation, having a tenacity of at least 27.0 grams per denier, as well as having the filament requirements set forth above. These characteristics are found in KEVLAR® Correctional™ manufactured by DuPont Company of Wilmington, Del. The plurality of woven sheets 14 of panel 12 preferably includes at least seventy (70) warp ends per inch and at least seventy (70) fill ends per inch providing the tightness of the weave contributing to the puncture resistance. This weave can be balanced or imbalanced and if imbalanced, preferably the number of warp ends exceed the number of fill ends.

The needed thinness of the present invention to permit the comfort, wearability, concealment under the clothing of the wearer and continuous coverage from the waist area downward over the groin area as well as the needed protection preferably requires the embodiment for the puncture resistant panel 12 to have at least eight woven sheets 14 which overlie one another. This configuration of the woven sheets 14 is demonstrated, with at least twelve (12) woven sheets as seen in FIG. 3. At twelve woven sheets 14, the total thickness of is at 0.08 inches and is at 0.32 pounds per square foot providing substantial comfort and thinness needed for concealment of the garment while also providing excellent protection against puncture attacks.

Depending on a need for greater needed protection level, the protective garment 10 is constructed of at least two sub-panels 60, as seen in FIG. 5. Each sub-panel 60 includes less than the total number of the plurality of sheets 14. The configuration of these sub-panels 60 overlying one another in panel 12 is shown in FIG. 3. These sub-panels 60 formed of adjacent woven sheets 14 maintain an overlying relationship together within each sub-panel 60 whereby pieces of tape 62 are preferably utilized on opposing ends of panel 12 for securement. Additional securement is also provided with rows of stitching 64 positioned at remote corners of each sub-panel 60 and oriented so as to avoid overlapping or overlying of adjacent rows of stitching 64 with each sub-panel 60 aligned and overlying one another.

Figure 6A:
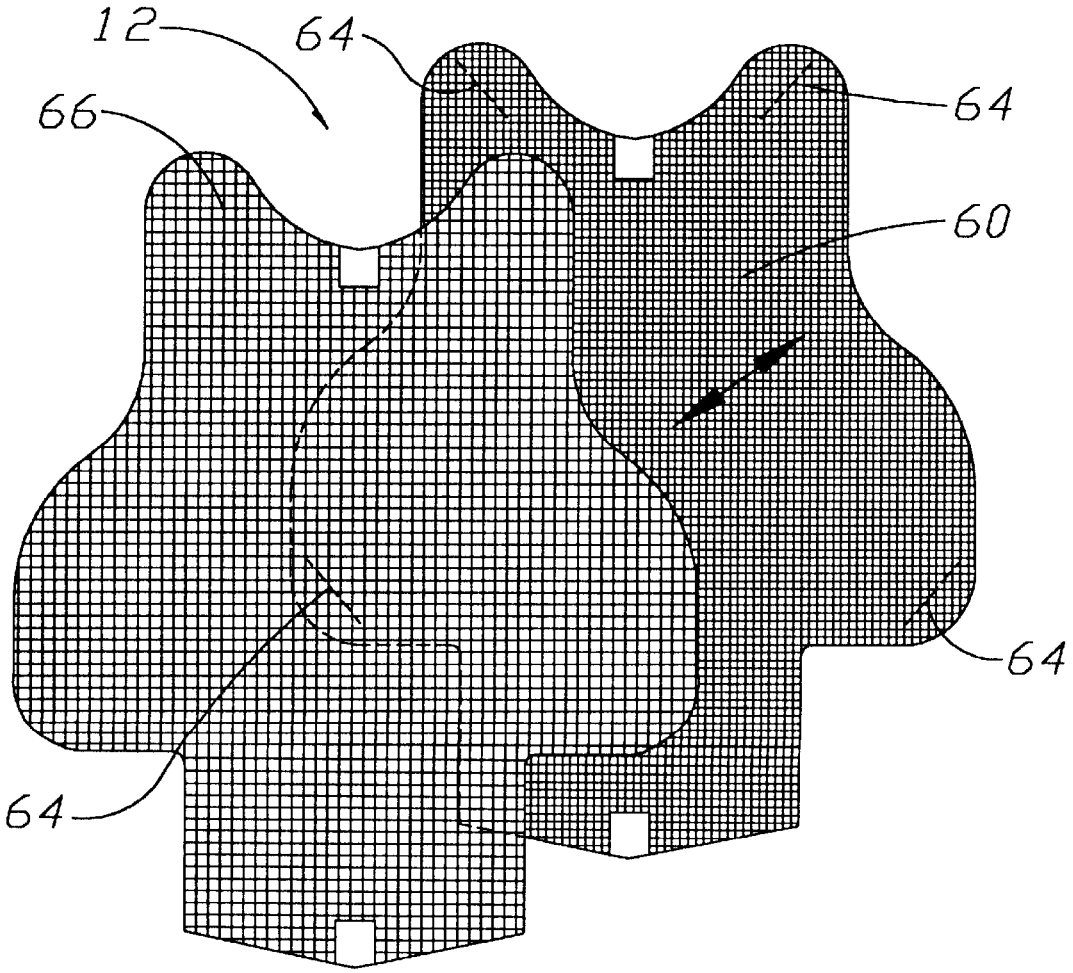
FIG. 6A is an exploded view of another embodiment of the panel of the front portion of the protective garment without a sleeve.

A second embodiment of construction of panel 12 is shown in FIG. 6A which likewise resists puncture from sharp weapons and ballistic missiles shot from a gun. This particular construction, without coverage from over the waist area of the wearer continuous over the groin area, is described in U.S. patent application Ser. No. 08/691,251 entitled "Puncture Resistant Protective Garment And Method For Making And Testing Same" filed Aug. 2, 1996, by Thomas E. Bachner, Jr., assigned to the assignee of the present application and is hereby incorporated by reference.

The embodiment of the protective garment 10 which provides this dual protection includes another panel 66, of ballistic resistant construction, used to overlie puncture resistant panel 60, described immediately above. Panel 66 which is of ballistic resistant construction for resisting gun shot projectiles of at least one of a) a woven fiber constructed of filaments having less than sixty (60) warp ends and less than sixty (60) fill ends per inch and having greater than 90,000,000 filament crossovers per square inch, and b) a composite material.

It is recommended that for better performance that the puncture resistant panel 60 is positioned closer to the wearer's body than the other ballistic resistant panel 66. Should, for example, two puncture resistant panels 60 be used, the ballistic resistant panel 66 should be positioned either in between the two puncture resistant panels 60 or in front of both of them. A preferred design has the other or ballistic resistant panel 66 positioned at a strike face of garment 10.

The ballistic panel 66 is preferably constructed of a plurality of sheets 14 of woven high strength protective fibers. Aramid fibers such as high strength polymer KELVAR® fibers of a denier greater than 200 denier and other comparable fibers are preferably employed is the weave forming the ballistic resistant sheets. The construction of the ballistic panel 66 is flexible having generally significantly less than sixty (60) warp ends per inch and less than sixty (60) fill ends per inch. The warp ends represent the aramid fibers which extend along the length of the fabric and the fill ends are representative of the other fibers of the weave which are woven in generally a transverse direction to the warp ends. The sheets of the ballistic resistant panel 66 are preferably formed of a woven aramid fiber which are constructed of filaments having much greater than 90,000,000 filament crossovers per square inch.

The structural characteristics of the ballistic resistant panel 66 render it suitable for stopping penetration of a projectile object such as a bullet shot from a firearm. Such characteristics differ from the novel structural characteristics of fiber weave properties combined with particular fiber strength, fiber compound, filament crossover range, break elongation percentage, denier, tenacity and strength described above for the puncture resistant panel whereby such combination enables the puncture resistant panel to protect against and prevent penetration from various knives, blades, shanks, awls and other sharp objects. The woven sheets 14 of ballistic resistant panel 66 are formed of aramid KEVLAR® fibers such as Nos. 29, 49, 129 and 149. Other fibers used in forming ballistic resistant fabrics include TWARON® T-1000 and T-2000 made by AKZO NOBEL, Inc. and SPECTRA® woven fabrics manufactured by Allied Signal, Inc. Various types of fibers may be suitably employed for this ballistic resistant construction which includes polyethylene fibers. Generations of fibers and fabrics made from these fibers have evolved beginning with the first generation of ballistic nylon; second generation of KEVLAR® 29, KEVLAR® 49, Twaron and SPECTRA®; third generation of Twaron T-2000 Microfilament, KEVLAR® 129 and KEVLAR® 49 fabrics; and fourth generation of Araflex$_{TM}$. Certain fibers have been found to be suitable for use in the construction of woven ballistic resistant garments. Such a ballistic resistant panel can be seen in U.S. Pat. No. 5,479,659 entitled "Lightweight Ballistic Resistant Garments and Method to Produce Same" issued Jan. 2, 1996 to Bachner, Jr. and is herein incorporated by reference and which is further referred to below regarding panel 66 having at least twenty-two sheets 14. Such a garment would preferably have an imbalanced weave of twenty-four by twenty-two fibers per inch and would utilize KEVLAR® which would provide between 100,000,000 to 275,000,000 crossovers.

Figure 6B:
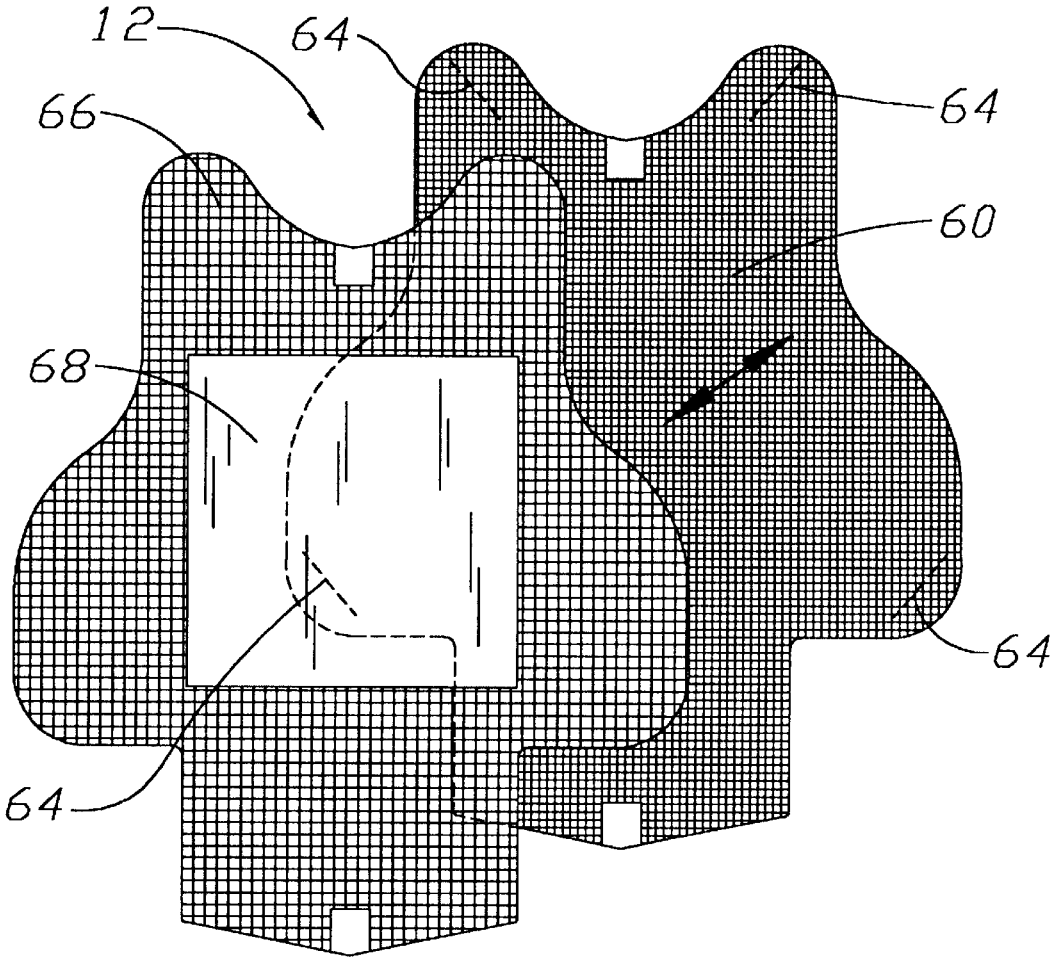
FIG. 6B is an exploded view of a variation of the embodiment in FIG. 6A.

Referring now to FIG. 6B, a variation of the embodiment to the hybrid or combination protective garment, shown in 6A. In this embodiment a composite material panel 68 is secured to ballistic resistant panel 66 for the ballistic resistant portion of the vest to overlie the puncture resistant panel 50 in order to prevent penetration of a ballistic missile or projectile through the ballistic resistant panel 66 positioned in front of the underlying puncture resistant panel 64. The ballistic resistant panel 66 of FIG. 6B, is constructed of the relatively looser woven Kevlar® aramid fiber, or the like, having the properties as described above. The composite material 68 for the ballistic resistant panel portion shown in the embodiment in FIG. 6B also includes a metallic sheet member 68 centrally positioned either at the frontal strike face area of the garment or disposed within the layered ballistic sheets 14 of the ballistic resistant panel 66.

Preferably, the composite material 68 is formed of a metal such as titanium or other suitable very strong metals, as well as, other suitable composite materials that are ballistic resistant such as ceramics, or SPECTRA SHIELD®, GOLD SHIELD® and GOLD FLEX® as well as other reinforced plastics manufactured by Allied Signal Inc. of Morris County, N.J., and other nonwoven composite materials and the like. These ballistic resistant materials woven and nonwoven (composite material) are used in the present invention either separately or individually with the puncture resistant panel or in combination with each other and the puncture resistant panel. Since composite material 68 typically is more rigid than woven fibers and it is preferable to position composite material 68 to be more in the chest area of the wearer and is spaced from the waist area or groin area where flexibility is needed. The member formed of composite material 68 may selectively be positioned within pockets 28, FIG. 2, of the outer carrier 26 for protection proximate the sternum chest region of the wearer. Numerous ballistic resistant panels have been developed utilizing woven aramid fibers or other comparable performance fibers, as well as, composite materials or both which are selectively used in this embodiment for panel 66.

Figure 7A:
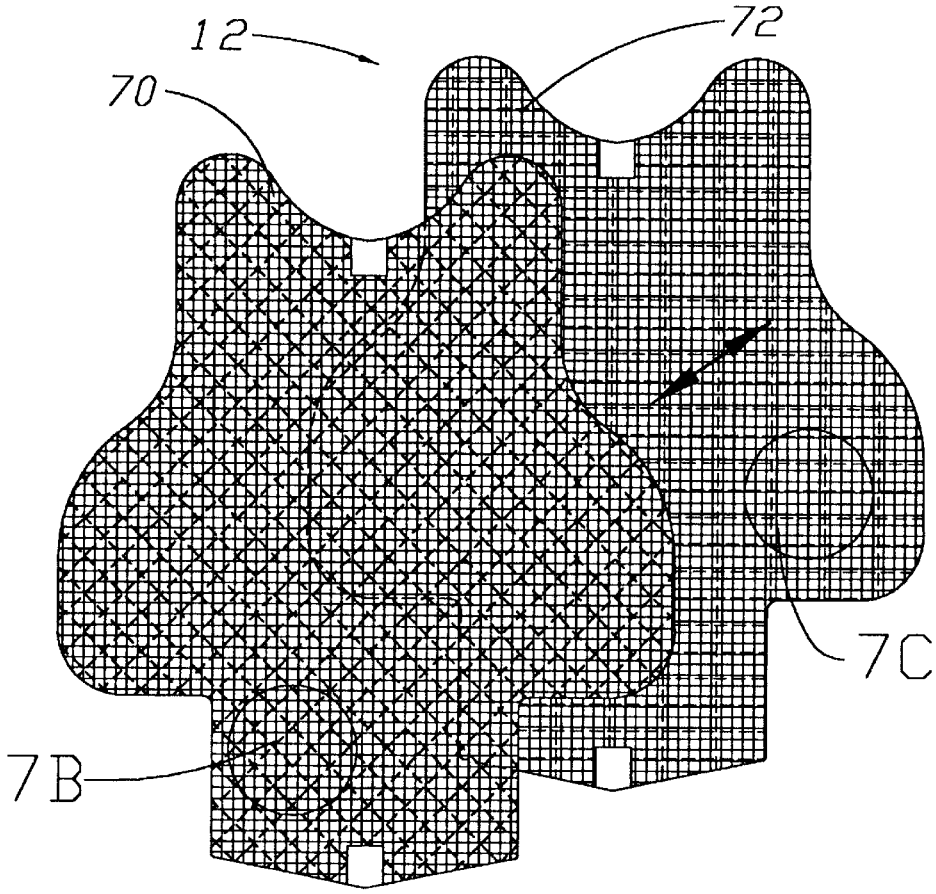
FIG. 7A is an exploded view of a second embodiment of sub-panels of the panel of the front portion of the protective garment without a sleeve.
Figure 7B:
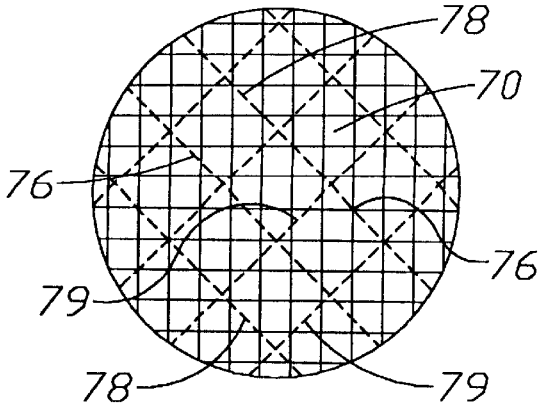
FIG. 7B is an enlarged view of that which is circled as 7B in FIG. 7A.
Figure 7C:
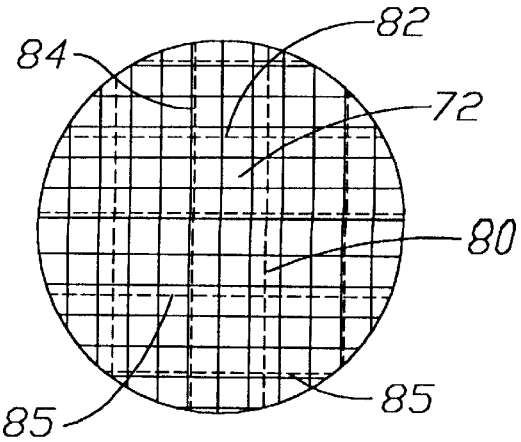
FIG. 7C is an enlarged view of that which is circled as 7C in FIG. 7A.

A third embodiment of construction of panel 12 is shown in FIGS. 7A–7C which resists penetration from ballistic missiles shot from a gun. The construction of a ballistic resistant panel for protection primarily of a chest region is manufactured and sold by Second Chance Body Armor, Inc. of Central Lake, Mich. as the Monarch® Level IIA which is described in U.S. Pat. No. 5,479,659, of Bachner, Jr. and assigned to Second Chance Body Armor, Inc. and is incorporated by reference above.

The embodiment of panel 12, in FIG. 7A, is ballistic resistant and includes first and second sub-panels 70, 72 which overlie one another and in which each of the first and second sub-panels 70, 72 comprises at least two sheets 14 in each panel. A preferred embodiment of this structure will carry approximately ten to twelve sheets 14 in each sub-panel.

A plurality of stitches 76 are disposed into the first sub-panel 70, as seen in FIGS. 7A and 7B, connecting the plurality of the sheets 14 together within the first sub-panel 70. These plurality of stitches 76 includes at least one row of stitches 78 aligned in a first direction and another plurality of stitches 80 are disposed into the second sub-panel 72, as seen in FIGS. 7A and 7C, connecting the sheets 14 together within the second sub-panel 72. The other plurality of stitches 80 includes at least two rows of stitches 82, 84 aligned in a second and third direction transverse to one another and in which the row of stitches 78 in the first sub-panel 76 in the first direction is transverse to rows 80, 82 of the second and third directions in the second sub-panel 72.

The first and second sub-panels 70, 72 are positioned adjacent to one another, as seen in FIG. 7A. The plurality of stitches 76 disposed in the first sub-panel 70 only and likewise, the other plurality of stitches 80 are disposed in the second sub-panel 72 only. It is preferable that the stitches within each sub-panel 70, 72 not cross over to the adjacent sub-panel.

A preferable configuration of stitches includes plurality of stitches 76 disposed in the first sub-panel 70 and includes a plurality of rows of stitches substantially parallel to one another 78 and spaced apart from one another and aligned substantially in the first direction. First sub-panel 70 has a plurality of other rows of stitches 79 substantially parallel to one another and spaced apart from one another, as seen in FIG. 7B. The plurality of the other rows of stitches 79 are positioned transverse to the of rows of stitches 78 positioned in the first direction. In the second sub-panel 72 another plurality of stitches 80 disposed in the second sub-panel 72 includes a plurality of rows of stitches 84 substantially parallel to one another and spaced apart from one another and aligned substantially in the second direction and a plurality of rows of stitches 85 substantially parallel to one another and spaced apart and aligned substantially in the third direction.

It is preferable that fibers of the weave of this embodiment have a filament cross-overs per square inch in a range of 2,000,000 to 1,000,000,000. Additionally, the plurality of stitches discussed above are preferably composed of an aramid.

This structure provides that panel 12 includes at least 22 sheets with a thickness of 0.20 inches and a weight of 0.75 pounds per square foot. As a result, the panel 12 provides the desired ballistic resistance and the flexibility and thinness necessary to be positioned under the clothing of the wearer and extend continuously from the waist area to and over the groin area of the wearer.

The preferred method for positioning protective garment 10 onto a wearer includes the steps of placing a panel 12 constructed of a plurality of sheets 14. Each sheet 14 is constructed of flexible woven high strength protective fibers such as aramid fibers and the like in which the plurality of sheets 14 are contiguously formed to overlie the chest area 16 and extend continuously downwardly to overlie the waist 18 and groin 20 areas of the wearer.

Panel 12 is releasably secured to the body of the wearer, as seen in FIG. 1 with securing apparatus 22 as discussed above in more detail. The method includes positioning wearing apparel garments which engage the waist area of the wearer, such as pants or a skirt or the like, to overlie panel 12 which will extend downwardly therefrom to overlie panel 12 at the groin 20 area.

This method includes providing the structure of the various embodiments of garment 10 for concealment and positioning continuously from at least the waist area downwardly over the groin area of the wearer as discussed in detail above, as well as, positioning and securing it onto the body of the wearer as previously described.

While a detailed description of the preferred embodiments of the invention have been given, it should be appreciated that many variations can be made thereto without departing from the scope of the invention as set forth in the appended claims.

I claim:

1. A protective garment for covering a frontal chest, waist and groin areas of a wearer, comprising:

a ballistic resistant panel having first and second sub-panels which overlie one another, the first and second sub-panels each have at least two sheets constructed of flexible woven high strength protective fibers in which the ballistic resistant panel is formed for underlying clothing covering the frontal chest area of the wearer and in which the panel extends continuously to overlie the frontal chest area down to and over the frontal waist and groin areas of the wearer; and a plurality of stitches disposed into the first sub-panel connecting the at least two sheets together within the first sub-panel in which the plurality of stitches include at least one row of stitches aligned in a first direction and another plurality of stitches are disposed into the second sub-panel connecting the at least two sheets together within the second sub-panel in which the other plurality of stitches include at least two rows of stitches aligned in second and third directions transverse to one another and in which the row of stitches in the first sub-panel in the first direction is transverse to the rows of said second and third directions in the second sub-panel.

2. The protective garment of claim 1 including a puncture resistant panel constructed of sheets of woven high strength protective aramid fibers with the sheets having a weave of at least 60 aramid fibers per inch in a direction and at least 60 aramid fibers per inch in another direction transverse to the direction and in which said aramid fibers have at least one of the following characteristics of: a) said aramid fibers are constructed of filaments which provide from 50,000,000 up 90,000,000 filament crossovers per square inch in said sheets of the puncture resistant panel, b) said aramid fibers have a break elongation which is greater than 3 percent and c) said aramid fiber provides greater than a 23.8 grams per denier tenacity.

3. The protective garment of claim 2 in which said aramid fiber of the puncture resistant panel is at least 200 denier.

4. The protective garment of claim 2 in which said aramid fibers of the puncture resistant panel have a break elongation of at least 3.45%.

5. The protective garment of claim 2 in which said aramid fibers of the puncture resistant panel have a tenacity of at least 27.0 grams per denier.

6. The protective garment of claim 2 in which said characteristics include at least two of the characteristics of a), b) or c).

7. The protective garment of claim 2 in which said characteristics include all of the characteristics of a) through c).

8. The protective garment of claim 2 in which said puncture resistance panel contains at least twelve woven sheets.

9. The protective garment of claim 2 in which said puncture resistance panel is at least 0.08 inches in thickness.

10. The protective garment of claim 2 in which said puncture resistance panel is at least 0.32 pounds per square foot.

11. The protective garment of claim 2 in which the sheets of the ballistic resistant panel have less than 60 warp ends and less than 60 fill ends per inch and in which the woven fiber of the ballistic resistant panel is constructed of filaments having greater than 90,000,000 filament crossovers per square inch of said ballistic resistant panel positioned to overlie the puncture resistant panel.

12. The protective garment of claim 11 in which said puncture resistant panel is positioned closer to a body of the wearer than said ballistic resistant panel.

13. The protective garment of claim 11 in which said ballistic resistant panel is positioned at a strike face of said garment.

14. The protective garment of claim 11 in which said ballistic resistant panel has sheets of woven aramid fibers of a denier greater than 200 denier.

15. The protective garment of claim 11 in which the sheets of the ballistic resistant panel are constructed of woven aramid fibers.

16. The protective garment of claim 11 in which said ballistic resistant panel includes a metallic sheet member.

17. The protective garment of claim 11 in which said ballistic resistant panel includes reinforced plastic material.

18. A protective garment for covering a frontal chest, waist and groin areas of a wearer, comprising:

a ballistic resistant panel constructed of a plurality of sheets constructed of flexible woven high strength protective fibers in which the panel is formed for underlying clothing covering the frontal waist area of the wearer and in which the panel extends continuously to overlie the frontal chest area down to and over the frontal waist and groin areas of the wearer and in which the panel includes first and second sub-panels which overlie one another;

the first and second sub-panels each have at least two of said sheets;

a plurality of stitches are disposed into the first sub-panel connecting said at least two sheets together within the first sub-panel in which said plurality of stitches includes at least one row of stitches aligned in a first direction and another plurality of stitches are disposed into the second sub-panel connecting said at least two sheets together within the second sub-panel in which said another plurality of stitches includes at least two rows of stitches aligned in a second and third direction transverse to one another and in which the row of stitches in the first sub-panel in said first direction in said first panel is transverse to said rows of said second and third directions in the second sub-panel; and means for releasably securing the panel to and maintaining the panel in a position overlying the frontal chest, waist and groin areas of the wearer.

19. The protective garment of claim 18 in which said first and second sub-panels are positioned adjacent to one another.

20. The protective garment of claim 18 in which said plurality of stitches are disposed in the first sub-panel only and in which said another plurality of stitches are disposed in the second sub-panel only.

21. The protective garment of claim 18 in which said fibers of said weave have a micro-filament cross-overs per square inch in a range of 2,000,000 to 1,000,000,000.

22. The protective garment of claim 18 in which said plurality of stitches and said another plurality of stitches are composed of an aramid.

23. The protective garment of claim 18 in which said plurality of stitches disposed in said first sub-panel includes a plurality of rows of stitches substantially parallel to one another and spaced apart from one another and aligned substantially in said first direction and has a plurality of another row of stitches substantially parallel to one another and spaced apart from one another in which said plurality of another rows of stitches are positioned transverse to said plurality of row of stitches positioned in said first direction, and in which said another plurality of stitches disposed in said second sub-panel includes a plurality of rows of stitches substantially parallel to one another and spaced apart from one another and aligned substantially in said second direction and a plurality of rows of stitches substantially parallel to one another and spaced apart and aligned substantially in said third direction.

24. The protective garment of claim 18 in which said panel includes at least 22 sheets.

25. The protective garment of claim 18 in which said panel is at least 0.20 inches in thickness.

26. The protective garment of claim 18 in which said panel is at least 0.75 pounds per square foot.

27. The protective garment of claim 1 including a sleeve for covering and enclosing said panel in which the sleeve is substantially the same shape as said panel.

28. The protective garment of claim 27 in which said sleeve is constructed of waterproof and moisture vapor permeable material.

29. The protective garment of claim 27 including a carrier for enclosing and carrying said panel enclosed by said sleeve.

30. The protective garment of claim 1 includes a carrier sleeve for enclosing and carrying said panel.

31. The protective garment of claim 30 in which the carrier defines at least one pocket member positioned to overlie a vital anatomical area of the wearer in which an opening of the pocket releasably securer with means for releasably securing closed the pocket opening to a sidewall of the carrier.

32. The protective garment of claim 31 includes an insert ballistic resistant core panel for positioning within said pocket.

33. The protective garment of claim 32 in which said ballistic resistant core panel is composed of at least one of a plurality of flexible woven sheets of aramid fiber overlying one another and a panel of composite ballistic resistant material.

34. The protective garment of claim 1 in which the panel at the waist area extends around the sides of the wearer.

35. The protective garment of claim 1 in which said panel is narrower in width at the groin area than the panel at the waist area in which the panel extends downwardly from the waist area over the groin area and in which the panel tapers in width at a lower portion of the panel.

36. The protective garment of claim 1 including means for releasably securing the panel to wearer and maintaining the panel in a position overlying the frontal chest waist and groin areas of the wearer in which the securing means includes one end of each of two spaced apart straps secured to a top portion of the panel in which the two spaced apart straps rest on the shoulders of the wearer on either side of a head of the wearer.

37. The protective garment of claim 36 in which another end of each of said two spaced apart straps are secured to a back panel for overlying a back of the wearer.

38. The protective garment of claim 1 in which at least one strap member of the garment extends around a side of the wearer toward a back panel overlying a back of the wearer.

39. The protective garment of claim 38 includes one strap member and a strip disposed over the panel in which a first end of said one strap member and said strip carry releasably securing mating hook and loop members for releasably securing said first end at a desired position along said strip.

40. The protective garment of claim 39 includes a second strap member in which a first end of said second strap member and said strip carry releasably securing mating hook and loop members for releasably securing said first end of said second strap member at a desired position along said strip in which said second strap member extends around the wearer on an opposing side of the wearer than said one strap member.

41. A method for positioning a protective garment onto a wearer, comprising the steps of:

placing a ballistic resistant panel over chest, waist and groin areas of the wearer in which the ballistic resistant panel is constructed of a plurality of sheets constructed of flexible woven high strength protective fibers in which the plurality of sheets are formed to overlie the chest area and extend continuously downwardly to overlie the waist and groin areas of the wearer in which the ballistic resistant panel includes first and second ballistic resistant sub-panels which overlie one another and in which each of the first and second ballistic resistant sub-panels has at least two sheets and has a plurality of stitches being disposed into the first sub-panel connecting the at least two sheets together within the first sub-panel in which the plurality of stitches includes at least one row of stitches aligned in a first direction and another plurality of stitches are disposed into the second sub-panel connecting the at least two sheets together within the second sub-panel in which the other plurality of stitches includes at least two rows of stitches aligned in a second and a third direction transverse to one another and in which the row of stitches in the first sub-panel in the first direction is transverse to the rows of stitches in the second and third directions in the second sub-panel; and positioning a wearing apparel garment which engages the waist area of the wearer to overlie said panel and in which the wearing apparel garment extends downwardly from the waist area of the wearer to overlie and conceal said panel at the groin area of the wearer.

42. The method for positioning a protective garment of claim 41 in which the step of positioning the wearing apparel includes putting on a pair of pants and securing the waist portion of the pants over said panel.

43. The method for positioning a protective garment of claim 42 in which the step of positioning includes securing a belt over the waist portion of the pants securing the waist portion over said panel.

44. The method for positioning a protective garment of claim 41 including providing a puncture resistant panel having sheets of high strength protective aramid fibers with a weave of at least 60 aramid fibers per inch in a direction and at least 60 aramid fibers per inch in another direction transverse to the direction and in which said aramid fibers have at least one of the following characteristics of: a) said aramid fibers are constructed of filaments which provide from 50,000,000 up to 90,000,000 filament crossovers per square inch in said plurality of sheets of the puncture resistant panel, b) said aramid fibers have a break elongation which is greater than 3 percent and c) said aramid fiber provides greater than a 23.8 grams per denier tenacity.

45. The method for positioning a protective garment of claim 44 in which the step of placing includes the step of providing said puncture resistant panel with at least one of the following characteristics: a) said aramid fiber is at least 200 denier, b.) said aramid fibers have a break elongation of at least 3.45% and c.) said aramid fibers have a tenacity of at least 27.0 grams per denier.

46. The method for positioning a protective garment of claim 44 in which the step of placing includes providing said puncture resistant panel with at least twelve woven sheets.

47. The method for positioning a protective garment of claim 49 in which the step of placing includes providing said puncture resistant panel having at least 0.08 inches in thickness.

48. The method for positioning a protective garment of claim 47 in which the step of placing includes providing said puncture resistant panel having at least 0.32 pounds per square foot.

49. The method for positioning a protective garment of claim 41 in which the step of placing includes providing the sheets of the ballistic resistant panel with a weave having less than 60 warp ends and less than 60 fill ends per inch and in which the fiber of the ballistic resistant panel is constructed of filaments having greater than 90,000,000 filament crossovers per square inch of said ballistic resistant panel which is positioned to overlie said puncture resistant panel to prevent penetration through said garment.

50. The method for positioning a protective garment of claim 49 including the step of placing said puncture resistant panel to be positioned closer to the body of the wearer than the ballistic resistant panel.

51. The method for positioning a protective garment of claim 50 including the step of positioning said ballistic resistant panel at a strike face of said garment relative to the puncture resistant panel.

52. The method for positioning a protective garment of claim 49 in which the step of placing includes providing said ballistic resistant panel to include at least one of the following characteristics: a.) the plurality of sheets of woven aramid fibers having a denier greater than 200 denier and b.) the aramid fibers are high strength polymeric fibers.

53. The method for positioning a protective garment of claim 49 in which the step of placing includes providing said ballistic resistant panel to include at least one of the following: a.) a metallic sheet member and b.) reinforced plastic material.

54. A method for positioning a protective onto a wearer, comprising the steps of:

placing a panel over chest, waist and groin areas of the wearer in which the panel is constructed of a plurality of sheets constructed of flexible woven high strength protective fibers in which the plurality of sheets are formed to overlie the chest area and extend continuously downwardly to overlie the waist and groin areas of the wearer in which the panel includes first and second ballistic resistant sub-panels which overlie one another and in which each of the first and second sub-panels comprises at least two sheets and have a plurality of stitches being disposed into the first sub-panel connecting said at least two sheets together within the first sub-panel in which said plurality of stitches includes at least one row of stitches aligned in a first direction and another plurality of stitches are disposed into the second sub-panel connecting said at least two sheets together within the second sub-panel in which said another plurality of stitches includes at least two rows of stitches aligned in a second and a third direction transverse to one another and in which the row of stitches in the first sub-panel in said first direction is transverse to said rows of said second and third directions in the second sub-panel;

releasably securing the panel to the body of the wearer; and positioning a wearing apparel garment which engages the waist area of the wearer overlying said panel and in which the wearing apparel garment extends downwardly therefrom to overlie said panel at the groin area.

55. The method for positioning a protective garment of claim 54 in which the step of placing includes providing said first and second sub-panels to be positioned adjacent to one another.

56. The method for positioning a protective garment of claim 54 in which the step of placing includes providing said plurality of stitches to be disposed in the first sub-panel only and in which said another plurality of stitches are disposed in the second sub-panel only.

57. The method for positioning a protective garment of claim 54 including the step of providing said fibers of said weave to have a micro-filament cross-overs per square inch in a range of 2,000,000 to 1,000,000,000.

58. The method for positioning a protective garment of claim 54 including the step of providing said plurality of stitches to be composed of an aramid.

59. The method for positioning a protective garment of claim 54 including the step of providing said plurality of stitches disposed in said first sub-panel to include a plurality of rows of stitches substantially parallel to one another and spaced apart from one another and aligned substantially in said first direction and have a plurality of another row of stitches substantially parallel to one another and spaced apart from one another in which said plurality of another rows of stitches are positioned transverse to said plurality of row of stitches positioned in said first direction, and in which said another plurality of stitches disposed in said second sub-panel includes a plurality of rows of stitches substantially parallel to one other and spaced apart from one another and aligned substantially in said second direction and a plurality of rows of stitches substantially parallel to one another and spaced apart and aligned substantially in said third direction.

60. The method for positioning a protective garment of claim 58 in which the step of placing includes providing said panel to include at least 20 sheets.

61. The method for positioning a protective garment of claim 54 in which the step of placing includes providing said panel to have at least 0.20 inches in thickness.

62. The method for positioning a protective garment of claim 58 in which the step of placing includes providing said panel to have at least 0.75 pounds per square foot.

63. The method for positioning a protective garment of claim 41 in which the step of placing includes providing a sleeve for covering and enclosing said panel in which the sleeve is substantially the same shape as said panel.

64. The method for positioning a protective garment of claim 63 in which said sleeve is constructed of waterproof and moisture vapor permeable material.

65. The method for positioning a protective garment of claim 63 in which the step of placing includes providing a carrier for enclosing and carrying said panel enclosed by said sleeve.

66. The method for positioning a protective garment of claim 41 in which the step of placing includes providing a carrier sleeve for enclosing and carrying said panel.

67. The method for positioning a protective garment of claim 66 in which the step of placing includes providing at least one pocket member defined within said carrier and positioned to overlie a vital anatomical area of the wearer in which an opening of the pocket is releasably secured closed with means for releasably securing closed the pocket opening to a sidewall of the carrier.

68. The method for positioning a protective garment of claim 67 in which the step of placing includes providing an insert ballistic resistant core panel for positioning within said pocket.

69. The method for positioning a protective garment of claim 67 in which the step of placing includes providing said ballistic resistant core panel to be composed of at least one of a plurality of flexible woven sheets of aramid fiber overlying one another and a panel of composite ballistic resistant material.

70. The method for positioning a protective garment of claim 41 in which the step of placing includes providing the panel at the waist area to be capable of extending around the sides of the wearer.

71. The method for positioning a protective garment of claim 41 including the step of providing said panel to be narrower in width at the groin area than the panel at the waist area in which the panel extends downwardly from the waist area over the groin area and in which the panel tapers in width at a lower portion of the panel.

72. The method for positioning a protective garment of claim 41 including the step of releasably securing the panel to the body of the wearer with one end of each of two spaced apart straps to be secured to a top portion of the panel and in which the two spaced apart straps rest on the shoulders of the wearer on either side of a head of the wearer.

73. The method for positioning a protective garment of claim 72 in which the step of releasably securing includes providing another end of each of said two spaced apart straps to be secured to a back panel for overlying a back of the wearer.

74. The method for positioning a protective garment of claim 41 including the steps of releasably securing the panel to the body of the wearer, and providing at least one strap member to be secured to said panel and to extend around the wearer and secure to a back panel overlying a back of the wearer.

75. The method for positioning a protective garment of claim 73 in which the step of releasably securing includes providing one strap member and a strip disposed over the panel in which a first end of said one strap member and said strip carry releasably securing mating hook and loop members for releasably securing said first end at a desired position along said strip.

76. The method for positioning a protective garment of claim 75 in which the step of releasably securing includes providing a second strap member in which a first end of said second strap member and said strip carry releasably securing mating hook and loop members for releasably securing said first end of said second strap member at a desired position along said strip in which said second strap member extends around the wearer on an opposing side of the wearer than said one strap member.

* * * * *

UNITED STATES PATENT AND TRADEMARK OFFICE

CERTIFICATE OF CORRECTION

PATENT NO : 5,974,585

DATED : November 2, 1999

INVENTOR(S) : Thomas E. Bachner, Jr.

It is certified that error appears in the above-identified patent and that said Letters Patent is hereby corrected as shown below:

Col. 7, line 7, change "KELVAR®" to -- KEVLAR® --;

Col. 7, line 43, change "KEVLAR® 49" to -- KEVLAR® LT --;

Col. 7, line 65, change "Kevlar®" to -- KEVLAR® --; and

Col. 8, line 33, change "Monarch®" to -- MONARCH® --.

Signed and Sealed this

Twenty-sixth Day of December, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,974,585
DATED : November 2, 1999
INVENTOR(S) : Bachner, Jr.

It is certified that error appears in the above-identified patent and that said Letters Patent is hereby corrected as shown below:

Column 10,
Lines 40, 43 and 45, change “resistance” to -- resistant --;

Column 11,
Line 51, change “row” to -- rows --;

Column 12,
Line 12, change “securer” to -- secures --;

Column 13,
Line 54, change “49” to -- 44 --; and

Column 14,
Line 21, after “protective” insert -- garment --.

Signed and Sealed this

Sixth Day of April, 2004

JON W. DUDAS
*Acting Director of the United States Patent and Trademark Office*